US011426331B2

(12) United States Patent
Yang et al.

(10) Patent No.: US 11,426,331 B2
(45) Date of Patent: Aug. 30, 2022

(54) PACIFIER FOR INFANTS

(71) Applicants: Jin Souk Yang, Gyeonggi-do (KR); In Sook Ha, Incheon (KR)

(72) Inventors: Jin Souk Yang, Gyeonggi-do (KR); In Sook Ha, Incheon (KR)

( * ) Notice: Subject to any disclaimer, the term of this patent is extended or adjusted under 35 U.S.C. 154(b) by 0 days.

(21) Appl. No.: 16/980,554

(22) PCT Filed: May 30, 2018

(86) PCT No.: PCT/KR2018/006184
§ 371 (c)(1),
(2) Date: Sep. 14, 2020

(87) PCT Pub. No.: WO2019/177201
PCT Pub. Date: Sep. 19, 2019

(65) Prior Publication Data

US 2021/0000696 A1 Jan. 7, 2021

(30) Foreign Application Priority Data

Mar. 13, 2018 (KR) ..... 10-2018-0029184

(51) Int. Cl.
*A61J 17/00* (2006.01)
*A61J 11/00* (2006.01)
*A61J 11/02* (2006.01)

(52) U.S. Cl.
CPC ..... *A61J 17/1111* (2020.05); *A61J 11/0055* (2013.01); *A61J 11/02* (2013.01); *A61J 17/105* (2020.05); *A61J 17/001* (2015.05)

(58) Field of Classification Search
CPC ..... A61J 17/00; A61J 17/001; A61J 17/105; A61J 17/1111; A61J 11/00; A61J 11/0005;

(Continued)

(56) References Cited

U.S. PATENT DOCUMENTS 4,768,510 A * 9/1988 Leung ..... A61J 17/1011 606/234
5,292,335 A 3/1994 Shin
(Continued)

FOREIGN PATENT DOCUMENTS

KR 20-1984-0002306 U 6/1984
KR 20-1999-0010041 U 3/1999
(Continued)

*Primary Examiner* — Diane D Yabut
(74) *Attorney, Agent, or Firm* — IP Legal Services, LLC

(57) ABSTRACT

The present invention relates to a pacifier for infants used to comfort infants. More specifically, a silicone tube body (10), into which or from which air can be injected or discharged such that an infant feels the silicone tube body like a breast of the infant's mother when touching the silicone tube body, is coupled for use to a nipple-shaped nipple unit (50) by a secure coupling unit (30), and thus, due to the infant's touching of the silicone tube body, not only emotional security as if the infant were in the bosom of the infant's mother can be provided but also the development of the infant's brain can be beneficially stimulated, in comparison with traditional plastic pacifiers. Particularly, the nipple unit is not only simply coupled but also hermetically coupled by the secure coupling unit to a coupling ring formed at the front of the silicone tube body, and the silicone tube body has a valve through which air is smoothly injected or discharged, and thus the product not only can be assembled and taken apart for use but also provides great confidence and convenience of using air injection. In addition, when air is injected into the silicone tube body, the tube body is inflated not upward but downward so as to be prevented from blocking out the forward field of view of the infant sucking on the pacifier, and thus psychological security is more greatly provided for the infant.

4 Claims, 3 Drawing Sheets

(58) Field of Classification Search
CPC .. A61J 11/0035; A61J 11/005; A61J 11/0055; A61J 11/006; A61J 11/02; A61J 11/04; A61J 11/045; A61J 13/00; A61J 9/0607; A61J 9/08; A61F 2/12; A61F 5/003
See application file for complete search history.

(56) References Cited

U.S. PATENT DOCUMENTS

| | | | | |
|---|---|---|---|---|
| 6,315,796 | B1 * | 11/2001 | Eaton | A61F 2/02 623/23.67 |
| 2003/0150890 | A1 * | 8/2003 | Perricone | A61J 11/005 224/148.6 |
| 2004/0210252 | A1 | 10/2004 | Minoguchi et al. | |
| 2009/0270985 | A1 * | 10/2009 | Schuessler | A61F 5/0036 623/8 |
| 2011/0270309 | A1 | 11/2011 | Minoguchi et al. | |

FOREIGN PATENT DOCUMENTS

| | | | | |
|---|---|---|---|---|
| KR | 20-0204252 | Y1 | 11/2000 | |
| KR | 20-0212800 | Y1 | 2/2001 | |
| KR | 2002128000 | Y1 * | 2/2001 | A61J 9/06 |
| KR | 10-2007-0076192 | A | 7/2007 | |
| KR | 10-2011-0083582 | A | 7/2011 | |
| KR | 10-2014-0008222 | A | 1/2014 | |
| KR | 10-1915415 | B1 | 11/2018 | |

* cited by examiner

PACIFIER FOR INFANTS

CROSS REFERENCE TO RELATED APPLICATIONS

This application is a National Stage Patent Application of PCT International Patent Application No. PCT/KR2018/006184 (filed on May 30, 2018) under 35 U.S.C. § 371, which claims priority to Korean Patent Application No. 10-2018-0029184 (filed on Mar. 13, 2018), the teachings of which are incorporated herein in their entireties by reference.

TECHNICAL FIELD

The present invention relates to a pacifier for infants used to comfort infants, and more specifically, a pacifier for infants which includes a silicone tube body combined with a nipple-shaped part so that an infant feels like a mother's breast, thereby providing the infant with emotional security in his or her mother's arms when the infant touches the pacifier and helping improvement of brain development.

BACKGROUND ART

In general, a pacifier for infants is a product for infants used to soothe lap babies or infants.

A part going inside an infant's mouth, of the pacifier for infants, is molded of synthetic resin which is harmless to humans, and the pacifier for infants includes a nipple-shaped unit and a plaything unit combined with the nipple-shaped unit.

However, the plaything unit of the conventional pacifier for infants is simply molded of a plastic material so that an infant can play with the plaything unit while fingering it. Therefore, the conventional pacifier for infants provides the infant with curiosity and fun, but is not good since the infant feels hard when he or she touches the pacifier with his or her hands and causes emotional anxiety since the feeling obtained when the infant touches the pacifier is very different from the feeling obtained when the infant touches his or her mother's breast.

Particularly, tactility, comfort, warmth, and the likes for emotional development are very important. It is known that infants feel more tactility, comfort and warmth when they suck their mothers' breasts and it has a good effect on emotional development.

In the meantime, Korean Utility Model Registration No. 20-0212800, which has devised by the same inventors as the present invention, discloses a feeding bottle for infants, which includes a tube body capable of filling the inside with air in order to provide the feeling of a mother's breast. The inventors of the present invention studied to apply the feeding bottle for infants to a pacifier for infants in order to develop a product to help infants' emotional security and brain development.

DISCLOSURE

Technical Problem

Accordingly, the present invention has been made in an effort to solve the above-mentioned problems occurring in the prior arts, and it is an object of the present invention to provide a pacifier for infants which includes a nipple-shaped unit and a silicon tube body, which is coupled with the nipple-shaped unit and into which or from which air can be injected or discharged such that an infant can feel the silicone tube body like a breast of the infant's mother, thereby providing the infant with emotional security as if the infant were in the bosom of the infant's mother and helping the infant's brain development when the infant touches the pacifier.

It is another object of the present invention to provide a pacifier for infants, in which the nipple-shaped unit is simply coupled to the silicon tube body in an airtight way and into which or from which air is smoothly injected or discharged through a valve, thereby providing convenience and reliability in assembly, disassembly and air injection.

It is a further object of the present invention to provide a pacifier for infants of which the tube body is inflated downwards when air is injected into the silicon tube body so as not to block the view of the infant who has the pacifier in his or her mouth, thereby providing the infant with psychological security better.

Technical Solution

To achieve the above objects, the present invention provides a pacifier for infants including: a silicon tube body having a spherical body with flexibility so that an infant feels the body like a breast of the infant's mother when the infant touches the body, a valve for injecting air into the body or discharging air from the body, and a round coupling ring integrally formed on the rim of an opening part of the front to be thicker than the body; a secure coupling unit fit and coupled onto the coupling ring of the silicon tube body; and a nipple-shaped unit coupled to the secure coupling unit.

According to an embodiment of the present invention, the valve of the silicon tube body includes a split part cut in a straight line so that air can be injected or discharged, and right and left protrusions formed at both sides of a lower portion of the split part, and the right and left protrusions push out a cover sheet closely combined with the lower portion of the valve from the bottom of the split part so as to secure a gap space allowing air to be injected or discharged.

According to an embodiment of the present invention, the body of the silicon tube body has an upper portion which is thicker than the remainder and is expanded not upwards but downwards when air is injected, so as not to block the forward view of the infant while the infant has the nipple-shaped unit in the infant's mouth.

According to an embodiment of the present invention, the secure coupling unit includes a fixing member and a coupling member, wherein the fixing member has a ring-shaped coupling groove hermetically fit and coupled to the coupling ring of the silicon tube body on the outer circumference of the body, a tension retaining piece having a retaining jaw formed at the outer face and tensioning inwardly and outwardly, and a ring-shaped coupling protrusion formed on the same circumference as the tension retaining piece, wherein the ring-shaped coupling protrusion is inserted into the middle of the body and the coupling member has a coupling hole having a retaining groove formed on the inner circumference such that the retaining jaw of the tension retaining piece is caught to the retaining groove not to be separated, and a through hole which has a diameter smaller in diameter than the coupling hole and is formed to be stepped, and wherein a coupling part at the rear of the nipple-shaped unit is inserted between the ring-shaped coupling protrusion of the fixing member and a stepped jaw inside the coupling member so as not to be separated.

Advantageous Effects

The pacifier for infants according to an embodiment of the present invention includes the nipple-shaped unit and the silicon tube body, which is coupled with the nipple-shaped unit by the secure coupling unit and into which or from which air can be injected or discharged such that an infant can feel the silicone tube body like a breast of the infant's mother when touching the silicone tube body, thereby providing the infant with emotional security as if the infant were in the bosom of the infant's mother and helping the infant's brain development when the infant touches the pacifier, in comparison with traditional plastic pacifiers.

Particularly, the nipple unit is not only simply coupled but also hermetically coupled by the secure coupling unit to the coupling ring formed at the front of the silicone tube body, and the silicone tube body has the valve through which air is smoothly injected or discharged, and thus the product not only can be assembled and disassembled but also provides great confidence and convenience of using air injection. In addition, when air is injected into the silicone tube body, the tube body is swollen not upwards but downwards so as not to block out the view of the infant who is sucking on the pacifier, and thus psychological security is more greatly provided for the infant.

MODE FOR INVENTION

Figure 1:
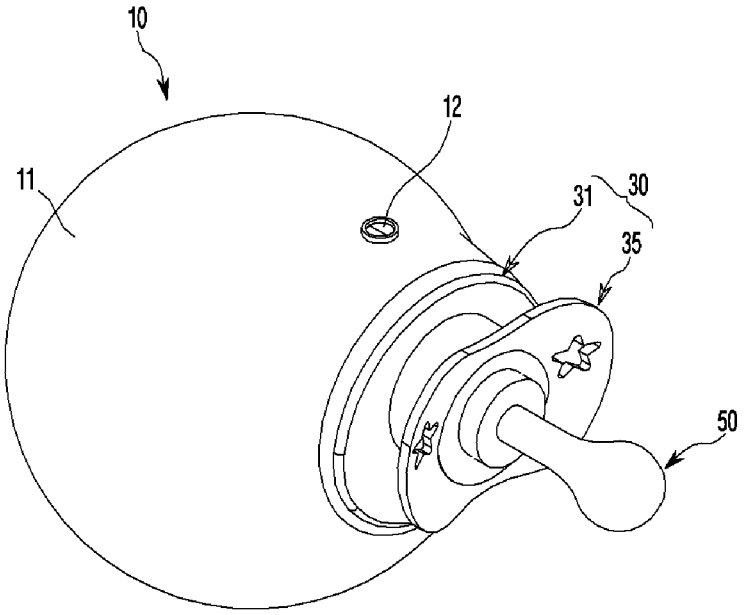
FIG. 1 is a perspective view showing the outward appearance of a pacifier for infants according to an embodiment of the present invention.
Figure 2:
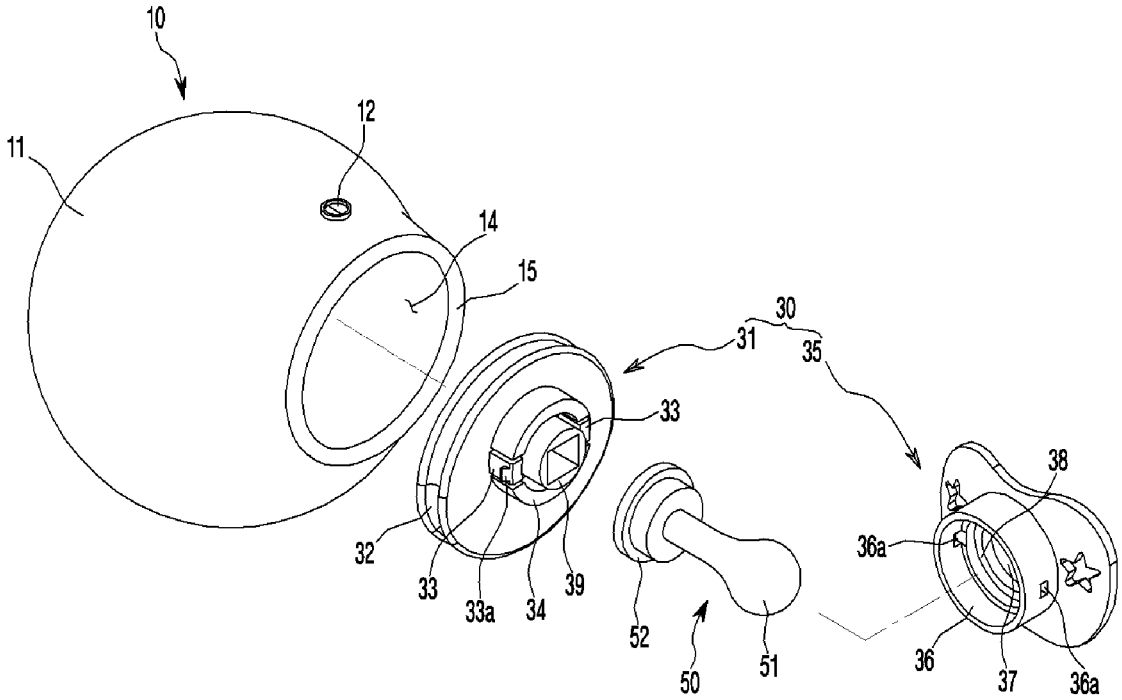
FIG. 2 is an exploded perspective view of FIG. 1.
Figure 3:
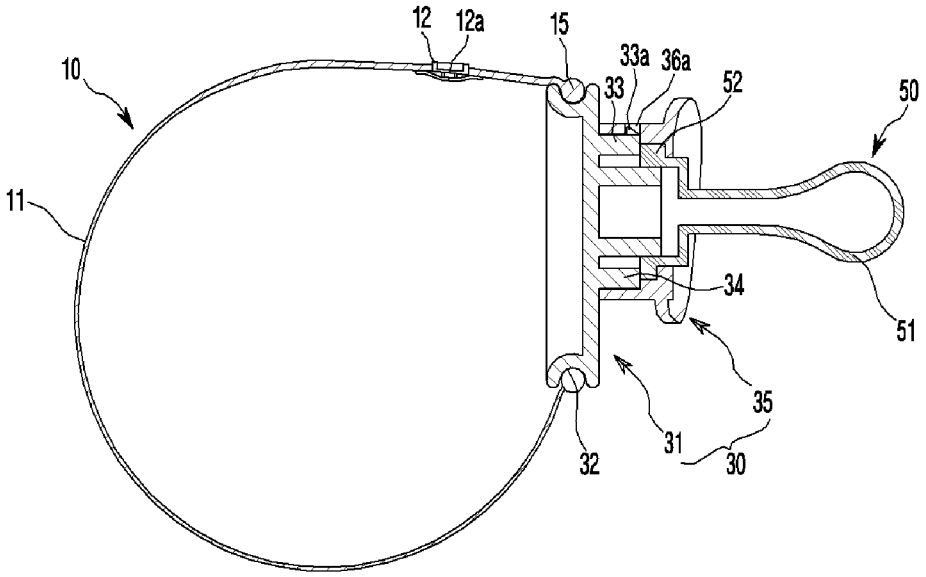
FIG. 3 is a front sectional view of FIG. 1.
Figure 4:
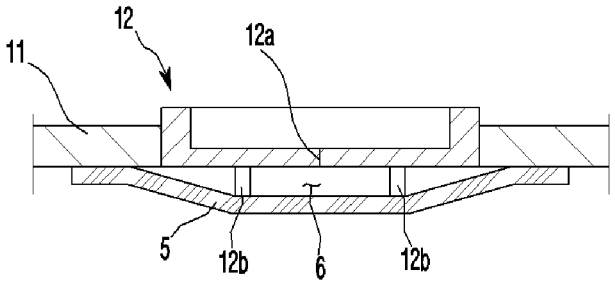
FIG. 4 is an enlarged sectional view showing a valve of FIG. 3.
Figure 5:
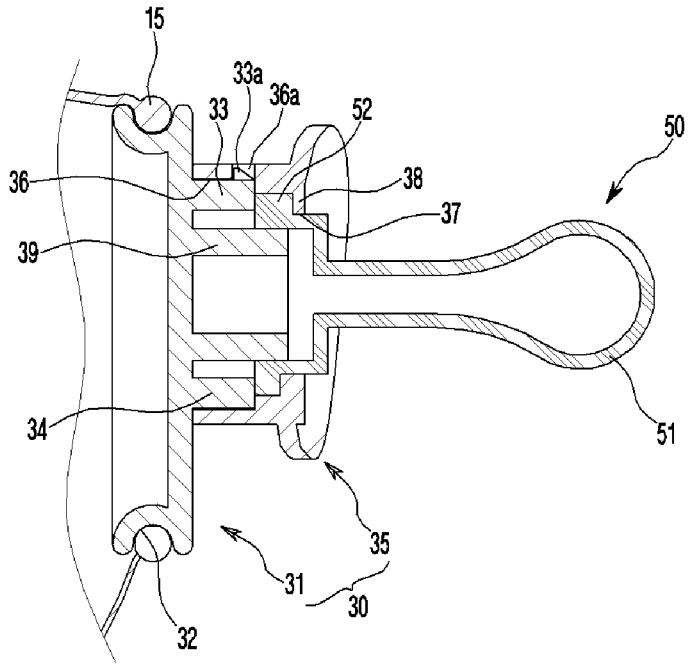
FIG. 5 is an enlarged sectional view showing a secure coupling unit and a nipple-shaped unit of FIG. 3.

Hereinafter, reference will be now made in detail to the preferred embodiment of the present invention with reference to the attached drawings.

As shown in FIGS. 1 to 6, a pacifier for infants according to an embodiment of the present invention includes a silicon tube body 10, a secure coupling unit 30, and a nipple-shaped unit 50.

The silicon tube body 10 is made of a flexible silicon material and has a spherical body 11 into which air is charged such that an infant feels it like the breast of his or her mother when the infant touches it.

The spherical body 11 of the silicon tube body 10 includes a valve 12 for injecting air into the body 11 or discharging air from the body 11, and a round coupling ring 15 integrally formed on the rim of an opening part 14 of the front to be thicker than the body 11.

Here, the valve 12 includes a split part 12*a* cut in a straight line so that air can be injected or discharged, and right and left protrusions 12*b* formed at both sides of a lower portion of the split part 12*a*. The right and left protrusions 12*b* push out a cover sheet 5 closely combined with the lower portion of the valve 12 from the bottom of the split part 12*a* so that a gap space 6 allowing air to be injected or discharged is formed so as to solve the problem that the cover sheet prevents air from being deflated while getting in contact with the split part.

In this instance, in a state where the cover sheet 5 gets in contact with the bottom of the valve, the border of the cover sheet 5 is bonded and at least one portion of the border is opened in such a way that a flow of air is usually prevented but the border is opened such that air is injected or discharged if it is necessary to inject or discharge air.

Moreover, preferably, the spherical body 11 of the silicon tube body 10 is swollen not upwards but downwards when air is injected so as not to block the view of the infant who is sucking on the nipple-shaped unit 50 combined with the front of the silicon tube body.

Figure 6:
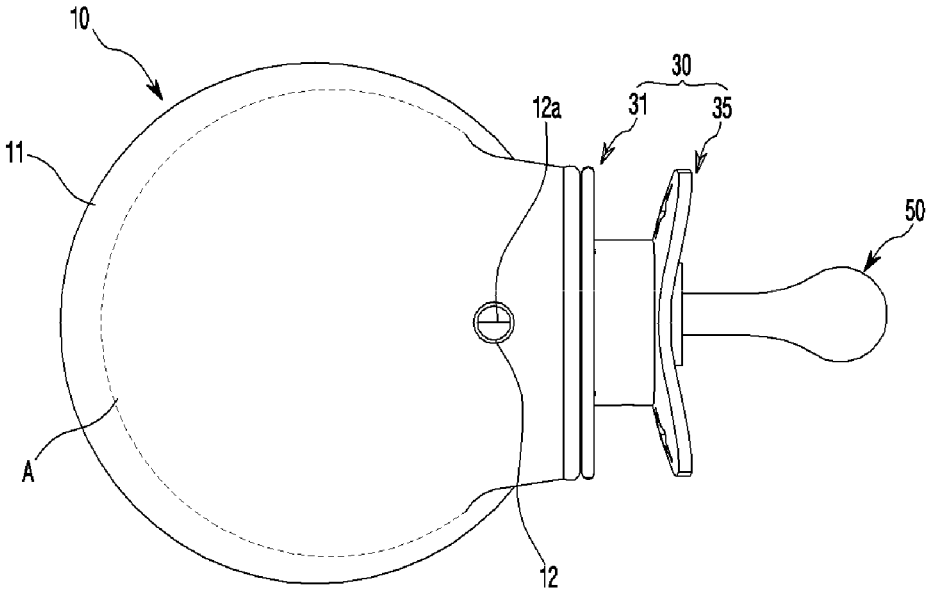
FIG. 6 is a plan view according to the embodiment of the present invention.

That is, as shown in FIG. 6, an upper portion A of the spherical body 11 is thicker than the remainder, for instance, an upper portion is 3 mm in thickness and the remainder is 0.9 mm in thickness, such that the body 11 is swollen downwardly convexly while not the upper portion but the remainder of the tube body is expanded downwards when air is injected.

The secure coupling unit 30 includes a fixing member 31 coupled to the coupling ring 15 of the silicon tube body and a coupling member 35 coupled to the front of the fixing member 31, and the nipple-shaped unit 50 is joined between the fixing member 31 and the coupling member 35.

The fixing member 31 is detachably and firmly fit on the coupling ring 15 on the outer circumference of the body, and includes a ring-shaped coupling groove 32 fixed and coupled hermetically, a tension retaining piece 33 having a retaining jaw 33*a* and tensioning inwardly and outwardly, and a ring-shaped coupling protrusion 34 formed on the same circumference as the tension retaining piece 33. The ring-shaped coupling protrusion 34 is inserted into the middle of the body of the coupling member 35, and the coupling member 35 includes a coupling hole 36 having a retaining groove 36*a* formed on the inner circumference such that the retaining jaw 33*a* of the tension retaining piece is caught to the retaining groove not to be separated, and a through hole 37 which has a diameter smaller in diameter than the coupling hole and is formed to be stepped.

The nipple-shaped unit 50 is made of a silicon material which is harmless to human bodies, and includes a ring-shaped coupling part 53 formed at the rear of a nipple 51. The coupling part 53 is inserted and coupled between the ring-shaped coupling protrusion 34 of the fixing member and a stepped jaw 38 of the coupling member so as to prevent separation.

The nipple-shaped unit 50 is coupled higher than the middle position of the secure coupling unit 30 such that the silicon tube body 10 is swollen not upwards but downwards so as not to block the forward view of the infant.

In the drawings, the unexplained reference numeral 39 designates a support protrusion protruding inwardly from the ring-shaped coupling protrusion 34.

Next, the operation and the action of the pacifier for infants according to the present invention will be described.

First, an assembling process of the pacifier for infants will be described. The fixing member 31 of the secure coupling unit 30 is coupled with the round coupling ring 15 formed on the rim of the opening part 14 of the front of the silicon tube body 10.

That is, the coupling ring 15 which is thicker than the body of the silicon tube body is tightly fit on the ring-shaped coupling groove 32 formed on the outer circumference of the fixing member 31 so as to be detachably and hermetically fixed.

In the above state, the nipple-shaped unit 50 is inserted into the coupling member 35 through the coupling hole 36 and the through hole 37 such that a coupling part 52 at the rear of the nipple-shaped unit 50 is inserted into the coupling member to be caught to the stepped jaw 38 inside the coupling member.

Furthermore, the coupling hole 36 of the coupling member 35 is inserted into the ring-shaped coupling protrusion 34 of the fixing member 31 and the retaining jaw 33*a* of the tension retaining piece 33 is resiliently inserted into the retaining groove 36*a* of the inner circumference of the coupling hole so as not to be separated.

At the same time, the coupling part 52 at the rear of the nipple-shaped unit is located to be inserted between the ring-shaped coupling protrusion 34 of the fixing member and the stepped jaw 38 inside the coupling member in order to support the nipple-shaped unit not to be separated.

As described above, the pacifier for infants according to the present invention is used while air is injected or discharged through the valve 12 after the nipple-shaped unit 50 is coupled to the silicon tube body 10. The split part 12*a* cut in the straight line is opened such that air can be injected or discharged.

Especially, the right and left protrusions 12*b* protruding from both sides of the bottom of the split part 12*a* push out the cover sheet 5 getting in contact with the bottom of the valve so as to secure the gap space 6. Therefore, the pacifier for infants can solve the problem that the cover sheet prevents air from being deflated while getting in contact with the split part and allow air to be smoothly injected and discharged.

The infant holds the silicon tube body 10 with both hands while having the nipple-shaped unit 50 in the infant's mouth. Because the silicon tube body 10 has the spherical body 11 made of the flexible silicon material, when the infant touches the pacifier, the pacifier for infants according to the present invention provides the infant with emotional security as if the infant were in the bosom of the infant's mother and the development of the infant's brain, in comparison with traditional plastic pacifiers.

Additionally, the body 11 of the silicon tube body has the upper portion A which is thicker than the remainder so as to be swollen not upwards but downwards when air is injected, and the nipple-shaped unit 50 coupled with the front of the silicon tube body is coupled higher than the middle position such that the silicon tube body 10 does not block the forward view of the infant while having the nipple-shaped unit 50 in the infant's mouth so as to provide the infant with psychological security.

The invention claimed is:

1. A pacifier for infants comprising:

a silicone tube body having a flexible hollow spherical body so that an infant feels the body like a breast of the infant's mother when the infant touches the body, a valve for injecting air into the body or discharging air from the body, and an opening, wherein the opening includes an integrally formed round coupling ring;

a secure coupling unit to fit and couple onto the coupling ring of the silicone tube body; and a nipple-shaped unit coupled to the secure coupling unit, wherein the valve of the silicone tube body includes a split part cut in a straight line so that air can be injected or discharged, and right and left protrusions formed at both sides of a lower portion of the split part, and the right and left protrusions push out a cover sheet closely combined with the lower portion of the valve from the bottom of the split part so as to secure a gap space allowing air to be injected or discharged.

2. The pacifier for infants according to claim 1, wherein the body of the silicone tube body has an upper portion which is thicker than a remainder of the body and is expanded not upwards but downwards when air is injected, so as not to block the forward view of the infant while the infant has the nipple-shaped unit in the infant's mouth.

3. The pacifier for infants according to claim 1, wherein the secure coupling unit includes a fixing member and a coupling member, wherein the fixing member has a ring-shaped coupling groove to hermetically fit and couple to the coupling ring of the silicone tube body on the outer circumference of the body, a tension retaining piece having a retaining jaw formed at an outer face and tensioning inwardly and outwardly, and a ring-shaped coupling protrusion formed on the same circumference as the tension retaining piece, wherein the ring-shaped coupling protrusion is inserted into the middle of the body and the coupling member has a coupling hole having a retaining groove formed on an inner circumference such that the retaining jaw of the tension retaining piece is caught to the retaining groove so as not to be separated from the retaining groove, and a through hole which has a diameter smaller in diameter than the coupling hole and is formed to be stepped, and wherein a coupling part at a rear of the nipple-shaped unit is inserted between the ring-shaped coupling protrusion of the fixing member and a stepped jaw inside the coupling member so as not to be separated from the fixing member and the coupling member.

4. The pacifier for infants according to claim 1, wherein the round coupling ring is integrally formed on a rim of an opening part of a front of the body to be thicker than then a wall of the body.

* * * * *